US007997864B2

(12) United States Patent
DeLeon

(10) Patent No.: US 7,997,864 B2
(45) Date of Patent: Aug. 16, 2011

(54) BLADE ARM

(76) Inventor: John C. DeLeon, Arlington Heights, IL (US)

( * ) Notice: Subject to any disclaimer, the term of this patent is extended or adjusted under 35 U.S.C. 154(b) by 282 days.

(21) Appl. No.: 12/319,445

(22) Filed: Jan. 7, 2009

(65) Prior Publication Data

US 2009/0175728 A1 Jul. 9, 2009

Related U.S. Application Data

(63) Continuation-in-part of application No. 11/094,063, filed on Mar. 30, 2005, now abandoned.

(60) Provisional application No. 60/557,255, filed on Mar. 30, 2004.

(51) Int. Cl.
*F04D 29/36* (2006.01)

(52) U.S. Cl. ..... 416/89; 416/210 R

(58) Field of Classification Search ..... 416/210 R, 416/246, 87, 88, 89, 205, 204 R, 248, 501, 416/153
See application file for complete search history.

(56) References Cited

U.S. PATENT DOCUMENTS 163,628 A * 5/1875 Bender ..... 416/205

* cited by examiner

*Primary Examiner* — Richard Edgar
(74) *Attorney, Agent, or Firm* — Niro, Haller & Niro

(57) ABSTRACT

A user adjustable variable axial length and variable pitch ceiling fan blade arm. The blade arm includes a pair of extension elements. Each element is threadably engaged with each other. At the other end of the extension elements are custom flanges for the purpose of attaching a fan blade and connecting the blade arm to a ceiling fan motor. The user can adjust the axial length and radial pitch of the blade arm by screwing in or out a threaded connection between the extension elements, and once the desired length and pitch is selected, the connection is secured by a connector, such as a hand and/or tool adjustable threaded lock.

1 Claim, 1 Drawing Sheet

BLADE ARM

PRIOR APPLICATION

The present application is a continuation in part of U.S. application Ser. No. 11/094,063, which in turn claims priority to Provisional U.S. Application No. 60/557255, filed Mar. 30, 2004, the contents of each of which are incorporated herewith.

FIELD OF INVENTION

The present invention relates to an adjustable fan blade arm which is characterized by a body portion having connection flanges at each end to connect the body portion to a fan blade and a ceiling fan motor. More specifically, a preferred embodiment of the present invention is particularly directed toward an axial or length adjustable and pitch adjustable blade arm for use with ceiling fan blades that are a part of a ceiling fan, wherein the connector is capable of multiple positions in an axial dimension relative to the body portion, and the connector has an exterior axial for gripping or adjustment which is greater in length than the interior threaded portion of the connector to facilitate a quicker and easier adjustment to the user's preference.

BACKGROUND OF THE INVENTION

Ceiling fans are very popular for facilitating air circulation in homes and businesses. As a result, various manufacturers construct and market ceiling fans to the public. Few manufacturers though, design and build ceiling fan blade bracket arms. However, current blade arms or bracket arms, as they are sometimes referred to, do not allow for the axial length of the actual blade arm and pitch of the fan blade to be adjusted. This can pose a problem for the user who may wish to adjust the fan based upon changing cooling and recirculation requirements. For instance, a user may wish to change the location of a fan within a home to a room having a larger (or smaller) room geometry. Likewise, the needs for recirculation and downdraft in a given location may change depending upon the season or the weather. In addition, the user may not want to have repeated trips up and down a step stool or ladder to have the right to make the appropriate adjustment, nor (for reasons of balance and safety) will a user wish to spend an inordinate amount of time obtaining the precise contact and adjustment of a conventional "nut and bolt" arrangement for the proper connection of the fan blade.

By allowing for the length of the blade arm to be adjusted, the fan can cover a greater diameter or area. Additionally, by allowing for the "pitch" of the blade arm to be adjusted, user can increase the amount of downdraft to be produced, thus circulating more air within a room area.

In view of the above, it can be seen that there is a need for a blade arm that allows for its axial length to be adjusted and furthermore, to afford the opportunity to change the "pitch" of the actual ceiling fan blade and for permitting a more flexible process and means for adjusting the fan blade.

OBJECTS AND SUMMARY OF THE INVENTION

A primary object of the disclosed invention is to provide a blade arm which can have its length adjusted and allow for the "pitch" of the ceiling fan blade to be changed as desired.

Description of the Prior Art

A common problem with existing blade arms (bracket arms) that are used with ceiling fans is that the design limitations limit the ability of such blade arms to allow the axial length and pitch to be adjusted as preferred. The actual length of the blade arm is constant and thus unadjustable. If the user prefers to increase the amount of area (diameter) of a room for example, that the fan blades cover, using conventional fan blade arms will not allow for this to be done. Additionally, current blade arm designs do not allow for the amount of downdraft produced by the pitch or degree of angle of the blade arm to be changed. By allowing for the pitch or degree of angle of the blade arm to be adjusted, there is a greater circulation of air flow throughout a room.

Prior designs in the art do not account for this problem in a simple and efficient manner. A typical prior art approach is shown in U.S. Pat. Nos. Wu (6,039,540) and Bucher (6,309,183). Both patents purport to describe fan blade assemblies that include a mounting arm with a mounting end. However, neither reference discloses or suggests the ability to adjust the axial length of each blade arm and pitch.

Another approach can be seen in U.S. Pat. No. 4,936,751 (Marshall). This patent again purports a fan blade assembly which includes a mounting arm with a mounting end. But again, the axial length and actual pitch where the fan blade connects to the blade arm is not adjustable.

Definition of Terms

The following terms are used in the claims of the patent as filed and are intended to have their broadest plain and ordinary meaning consistent with the requirements of law.

"axial direction"—The line or axis between: 1) the point at which the extension elements connect to the fan blade; 2) the point at which the extension elements connect to the ceiling fan motor.

"connector"—a component for connecting two or more elements to one another. The means for connecting is most preferably a structure which permits both a hand- tightened fit and a tool fit, although alternative embodiments may encompass either a hand tightened fit or a tool fit may also fall within the definition of this term.

Where alternative meanings are possible, the broadest meaning is intended. All words used in the claims set forth below are intended to be used in the normal, customary usage of grammar and the English language.

SUMMARY OF INVENTION

The apparatus of the present invention comprises an adjustable blade arm used with ceiling fans. The blade arm includes a plurality of extension elements which connect to a ceiling fan motor on one end and a fan blade on the other. The extension elements are preferably designed to connect to a stock ceiling fan motor and fan blade. The extension elements have a threaded engagement with one another, and are adjustably linked to one another via a tubular-shaped connector (collar), which is preferably reciprocally threaded to receive the extension elements.

The connector fixes the threaded engagement between the extension elements within an operator adjustable thread range. That is, the invention includes most preferably sufficiently long threaded mating portions on the extension elements such that the blade arm may be effectively lengthen by one inch or more, while the connector secures the attachment between the extension elements at the desired length, preferably by being manually tightened to engage one of the extension elements.

Accordingly, one object of the present invention is to provide an adjustable blade arm which can be used with stock ceiling fan motors and fan blades.

Another object of the present invention is to provide a blade arm whose length can be hand adjusted without the need for adjusting tools.

Still another object of the present invention is to provide a blade arm that allows for the pitch of the fan blade to be adjusted in a radial direction.

Yet another object of the present invention is to provide an adjustable blade arm attachment whereby both the length and the axial direction along with the pitch, are user adjustable.

Still another object of the present invention is to provide a more versatile means of circulating airflow.

Yet another object of the present invention is to provide a connector which is capable of quick adjustment by tool and or hand adjustment.

Still another object of the present invention is to provide a connector which may be axially adjusted or displaced relative to both the elements which it connects.

These and other objects, features, and advantages of the present invention will become more apparent in light of the following detailed description of a best mode embodiment thereof, and as illustrated in the accompanying drawings.

DETAILED DESCRIPTION OF THE INVENTION

Set forth below is a description of what is currently believed to be the preferred embodiment or best examples of the invention claimed. Future and present alternatives and modifications to this preferred embodiment are contemplated. Any alternatives or modifications which make insubstantial changes in function, in purpose, in structure or in result are intended to be covered by the claims in this patent.

Figure 1:
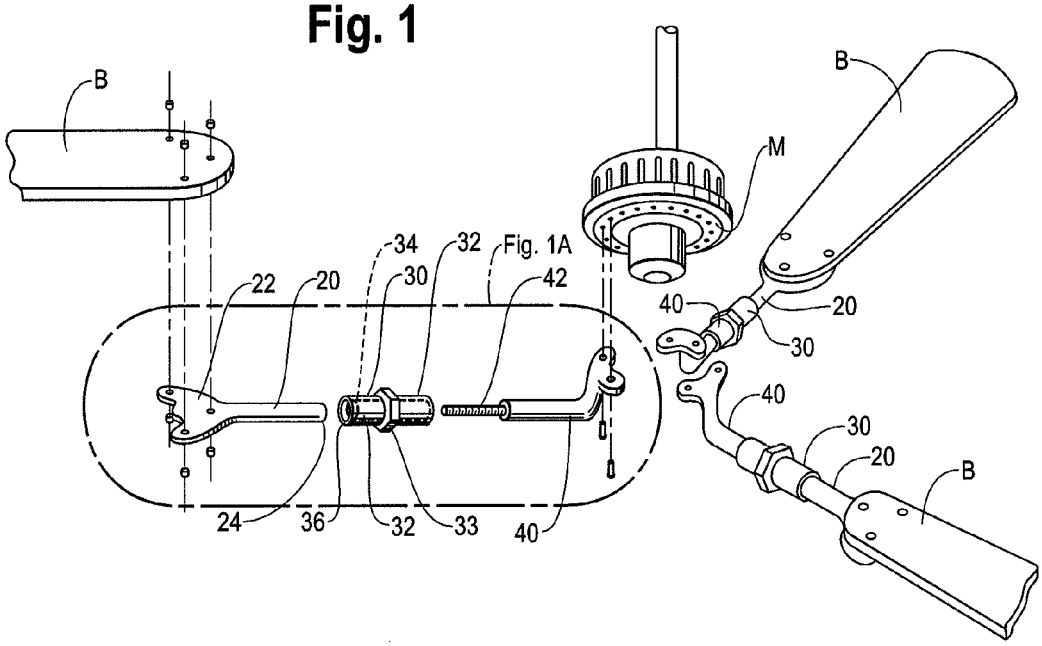
FIG. 1 shows an exploded front view of a preferred embodiment in accordance with the present invention.
Figure 1A:
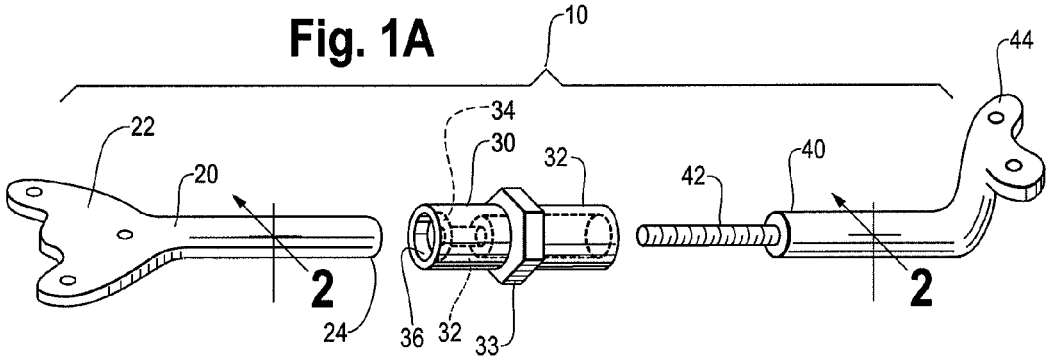
FIG. 1*a* shows another exploded front view of a preferred embodiment in accordance with the present invention.
Figure 2:
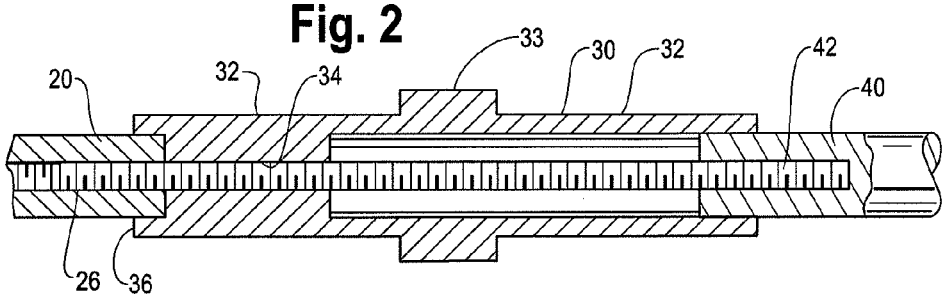
FIG. 2 shows a front view, partially exposed of the engagement between the connector and the extension elements.

FIGS. 1 and 2 show a first preferred embodiment of the present invention, comprising the blade arm 10, which includes a first proximal extension element 20, a connector 30 and a second or distal extension element 40.

The first extension element 20 is designed for mounting either integrally or by a separable attachment to a ceiling fan blade (not shown).

The first extension element most preferably includes a first end 22 comprising a connecting flange, shaped to attach with one end of a fan blade, and a second end 24 comprising another connecting flange that is designed to mate with connector 30. Second end 24 is also designed to mate with a second extension element 40.

Second extension element 40 includes a first male threaded end 42 for mating with the connector 30 and the second end 24 of the first extension element 20.

Second extension element 40 further includes a second end 44 most preferably comprising a mounting bracket for attachment to a motor (not shown) or similar driving components.

In a first preferred embodiment, however, the first and second extension elements 20 and 40 are 7¼ and 7 inches in total length, respectively, which includes their first and second ends, ⅝ of an inch in diameter, and are composed generally of stainless steel tubular shafts although the flange and mounting brackets will be of variable geometry. Each end of the extension element, 24 and 42 (i.e., where the first and second extension elements move), is most preferably internally threaded or bored to about 1" inch in length by approximately 10 mm in diameter. The term tubular is used to refer to the general external shape of a tube, i.e., cylindrical.

In this preferred embodiment, the male threads of the first end 42 and second extension element 40, is comprised of a single pitch stud for ease of manufacture. The pitch stud is 1.25" inch in length and ⅜ of an inch in diameter. The pitch stud is most preferably inserted or screwed ⅜" of an inch into the shaft of second extension element 40 and permanently connected by means of an adhesive, the selection and availability of a specific adhesive being known to those of ordinary skill in the art. Preferably only one pitch stud is utilized. Thus, a male thread will project outward, creating a male-female connection between the first and second extension elements. Those of ordinary skill in this field will understand that the present invention may also be practiced through alternative embodiments, such as male threads integrally manufactured and machined with the second extension element (i.e., instead of pitch studs) to arrive at the same function and result as this embodiment.

The invention further comprises the use of a connector 30. The connector is most preferably a tubular shaped locknut which includes a combined "knurled" outer or gripping surface 32 plus a smooth outer geometric surface 33, an inner threaded surface 34 and a second internal surface 36. The combined outer surfaces 32 and 33 are preferably of a greater axial length than the length of the inner threaded surface so as to improved the ease of gripping or other tool adjustment. The inner threaded surface is designed to create a threaded frictional locking engagement with the first end 42 of the second extension element, while the second internal surface 36 has a larger interior diameter for receiving the second end 24 of the first extension element and the shaft of the second extension element 40. This arrangement has the further benefit of permitting the connector 30 to mate the connector second internal surface 36 in a "flush" relationship with the second end 24 of the first extension element (without having to be flush with the shaft of the second extension element 40). Alternatively, the connector 30 can mate the shaft of the second extension element 40 in a "flush" fashion (without having to be flush with the second end 24 of the first extension element). Thus, the connector 30 of the present invention permits multiple axial locations relative to the first and second extension element for a more flexible arrangement for securing the fan blade than might be used in a convention "nut and bolt" relationship.

The connector 30 is disposed between the first and second connector elements 20, 40 to accommodate the user with a hand adjustable connection or a tool connection (e.g. a wrench). In other words, to operate this preferred embodiment of the present invention, the connector 30 is screwed onto the male thread 42 of an extension element (located in the example of FIGS. 1 and 2 on the first end 42 of second extension element 40), with that male thread 42 then mating with the reciprocal female thread 26 of the first extension element 20.

The connector 30 and the first and second extension elements 20, 40 are then attached (screwed) together to create the blade arm 10. The user then connects the Blade arm 10 to a ceiling fan rotor by inserting screws into the holes at the flange 44, which then are screwed into the ceiling fan rotor.

A second preferred embodiment further includes the use of a lock nut surface 32 defined on at least a portion of the exterior circumference of connector 30, to facilitate the connection of the extension elements through a tool tightened connection. A fan blade (not shown) is attached (screwed) onto the flange 22 of the first extension element 20 and the fan blades position can be changed by rotating the blade and securing its position by tightening the locknut (connector) accordingly. The connector 30 allows the user to rotate or adjust axial length and pitch of the first extension element 20, by rotating the first extension element 20 and/or connector 30 as desired, and then securing the desired position by tightening the locknut accordingly.

The operator can, when desired, increase or decrease the axial length of the blade arm by rotating extension element 20 in a radial direction. That is, the extension element 20 can be rotated in a radial direction (i.e., further screwed in or out) from its connection with extension element 40 and then secured by tightening the connector 30 accordingly.

In all of the preferred embodiments described above, the disclosed features allow the user to circulate more air throughout the room, adjust the amount of downdraft produced from each blade by adjusting its pitch and increasing or decreasing the area coverage of the fan blades by adjusting the axial length of the blade arm.

The above description is not intended to limit the meaning of the words used in the following claims that define the invention. Rather, it is contemplated that future modification in structure, function or result will exist that are not substantial changes and that all such insubstantial changes in what is claimed are intended to be covered by the claims. For instance, the selection of which extension elements use a "male thread" versus a female thread is for illustrative purposes with reference to the example drawings only. Likewise, it will be appreciated by those skilled in the art that various changes, additions, omissions, and modifications can be made to the illustrated embodiments without departing from the spirit of the present invention. All such modifications and changes are intended to be covered by the following claims.

What is claimed is:

1. An adjustable blade arm for connecting a fan blade to a motor, said blade arm comprising:

a) first and second extension elements extending generally along an axial direction, said pair of extension elements being adjustably connected to one another via a threaded engagement, at least one of said extension elements capable of having its length axially adjusted;

b) a connector for said extension elements, said connector adjustable in an axial direction relative to said first and second extension elements, said connector having an interior threaded portion and exterior surfaces for receiving both hand grip and tool for adjustment, said exterior surfaces having an axial length greater than said interior threaded portion, at least one of said extension elements extending radially through said connector for providing a user tool adjustable friction fit with said threaded engagement, whereby the connector secures a user selected length of said blade arm in said axial direction and a user selected radial orientation of said fan blade relative to said axial direction.

* * * * *